US010823489B2

(12) United States Patent
Yin

(10) Patent No.: US 10,823,489 B2
(45) Date of Patent: Nov. 3, 2020

(54) WASTE HEAT RECOVERY SYSTEM

(71) Applicant: RUENTEX ENGINEERING & CONSTRUCTION CO., LTD., Taipei (TW)

(72) Inventor: Samuel Yin, Taipei (TW)

(73) Assignee: RUENTEX ENGINEERING & CONSTRUCTION CO., LTD., Taipei (TW)

( * ) Notice: Subject to any disclaimer, the term of this patent is extended or adjusted under 35 U.S.C. 154(b) by 92 days.

(21) Appl. No.: 15/623,915

(22) Filed: Jun. 15, 2017

(65) Prior Publication Data

US 2018/0187963 A1 Jul. 5, 2018

(30) Foreign Application Priority Data

Dec. 29, 2016 (TW) ..... 105219946 U

(51) Int. Cl.
*F25D 23/12* (2006.01)
*F25D 31/00* (2006.01)
*F25D 23/00* (2006.01)

(52) U.S. Cl.
CPC ..... *F25D 23/12* (2013.01); *F25D 23/003* (2013.01); *F25D 31/005* (2013.01)

(58) Field of Classification Search
CPC ..... F25D 23/003; F25D 23/12; F25D 23/126; F25D 2400/02; F25D 21/00; F01K 27/02; F25B 27/02
See application file for complete search history.

(56) References Cited

U.S. PATENT DOCUMENTS 3,180,109 A * 4/1965 Kimmel ..... A47F 3/04 62/255
4,680,941 A * 7/1987 Richardson ..... F24D 17/02 62/184
6,101,835 A * 8/2000 Butsch ..... B67D 1/0864 222/146.1
6,264,830 B1 * 7/2001 Plester ..... C02F 9/005 210/103
8,495,893 B2 * 7/2013 Alajimi ..... B67D 3/0009 165/42
2003/0121641 A1 * 7/2003 Schulak ..... F25D 13/00 165/45

(Continued)

FOREIGN PATENT DOCUMENTS

JP 5816422 B2 * 11/2015 ..... F24H 1/00

*Primary Examiner* — Jianying C Atkisson
*Assistant Examiner* — Meraj A Shaikh
(74) *Attorney, Agent, or Firm* — David Postolski, Esq.; Gearhart Law LLC

(57) ABSTRACT

A waste heat recovery system is provided. The system comprises: an appliance, a tank, a pump and a pipeline switch. The appliance comprises: a housing, a refrigeration module, a heat exchanger, and a circulating water pipe. The tank is for storing heat energy generated from the refrigeration module with water therein and/or pumping water having the saved heat energy to the circulating water pipe to heat a space provided in the appliance. The pipeline switch controls water flow between the tank, the heat exchanger and the circulating water pipe. The system allows the appliance therein to refrigerate, thaw, and/or cook food, and it reduces electric energy consumption.

7 Claims, 3 Drawing Sheets

(56) References Cited

U.S. PATENT DOCUMENTS

| | | | | |
|---|---|---|---|---|
| 2005/0139552 | A1* | 6/2005 | Forsberg | E03B 3/28 62/635 |
| 2007/0101730 | A1* | 5/2007 | Chen | F25D 21/04 62/6 |
| 2009/0159611 | A1* | 6/2009 | Roetker | B67D 1/0858 222/1 |
| 2012/0031120 | A1* | 2/2012 | Swarup | F25D 21/12 62/82 |
| 2012/0151946 | A1* | 6/2012 | Decaestecker | F25B 29/003 62/79 |

* cited by examiner

WASTE HEAT RECOVERY SYSTEM

CROSS-REFERENCE TO RELATED APPLICATION

The present invention claims the benefit of priority of Taiwan application No. 105219946 of Dec. 29, 2016, entitled "Appliance Waste Heat Recovery Apparatus," the content of which is herein incorporated by reference.

BACKGROUND OF THE INVENTION

Field of the Invention

The present invention relates to a waste heat recovery system, and more particularly to a waste heat recovery system involving household appliances.

Description of the Related Art

With continuous development of science and technology, more and more diversified food-cooking apparatuses are available, such as a microwave oven, an oven, a rice cooker, an induction cooker, or a steamer, which improve human daily life and the quality of one's diet. However, food is easily spoiled at room temperature, resulting in the loss of original nutrition and the quality of the food. Therefore, it is of great importance that food be preserved at a low temperature to secure its freshness.

A household appliance such as a refrigerator is quite common in these times for preserving food. A refrigerator can store various foods or beverages at a low temperature so that the articles are cooled and/or frozen for preservation. However, it is well known that a refrigerator generates waste energy such as waste heat when in use. Such waste energy is mostly discharged or dissipated in the air and is not reused or recovered for other purposes.

With increasing awareness of environmental protection and the highlights of the importance of green energy in recent years, a waste heat recovery system that can recycle/recover energy generated from a household appliance is needed.

SUMMARY OF THE INVENTION

The present invention provides a waste heat recovery system that can recycle heat energy generated by a household appliance so as to effectively reduce electric energy consumption and achieve an environmental protection goal. Furthermore, the household appliance in the system has refrigeration, thawing, and/or cooking functions.

In one embodiment of the present invention, a waste heat recovery system is provided. The system comprises: an appliance, a tank, a pump and a pipeline switch. The appliance comprises: a housing, a refrigeration module, a heat exchanger, and a circulating water pipe. The housing has a space therein and the space is formed of a plurality of side walls. The refrigeration module is disposed between a first side wall of the plurality of side walls and the housing, for maintaining the space at a refrigeration temperature and heat dissipation. The heat exchanger is disposed between the housing and the refrigeration module and is configured to absorb the heat energy, wherein the heat exchanger has a first inlet end and a first outlet end. The tank has a first water inlet, a second water inlet, and a first water outlet. The first water inlet of the tank is connected to the first outlet end of the heat exchanger, and the second water inlet of the tank is connected to the second outlet end of the circulating water pipe. The pump has a third water inlet and a second water outlet, and the third water inlet of the pump is connected to the first water outlet of the tank. The pipeline switch has a fourth water inlet, a third water outlet, and a fourth water outlet. The fourth water inlet of the pipeline switch is connected to the second water outlet of the pump, and the third water outlet of the pipeline switch is connected to the first inlet end of the heat exchanger. The fourth water outlet of the pipeline switch is connected to the second inlet end of the circulating water pipe. The pipeline switch is configured to switch between the third water outlet and the fourth water outlet thereof.

In an alternative embodiment, the tank, the pump, and the pipeline switch of the above embodiment are disposed between the housing and a third side wall of the plurality of side walls.

In a further embodiment of the present invention, a waste heat recovery system is provided. The system comprises: an appliance, a tank, a first pump and a second pump. The appliance comprises: a housing, a refrigeration module, a heat exchanger and a circulating water pipe. The housing has a space therein, and the space is formed of a plurality of side walls. The refrigeration module is disposed between a first side wall of the plurality of side walls and the housing, for maintaining the space at a refrigeration temperature and heat dissipation. The heat exchanger is disposed between the housing and the refrigeration module and is configured to absorb the heat energy, wherein the heat exchanger has a first inlet end and a first outlet end. The circulating water pipe is disposed between a second side wall of the plurality of side walls and the housing, wherein the circulating water pipe has a second inlet end and a second outlet end. The tank has a first water inlet, a second water inlet, a first water outlet, and a second water outlet. The first water inlet of the tank is connected to the first outlet end of heat exchanger, and the second water inlet is connected to the second outlet end of the circulating water pipe. The first pump is connected between the first water outlet of the tank and the first inlet end of the heat exchanger. The second pump is connected between the second water outlet of the tank and the second inlet end of the circulating water pipe.

PREFERRED EMBODIMENT OF THE PRESENT INVENTION

Figure 1:
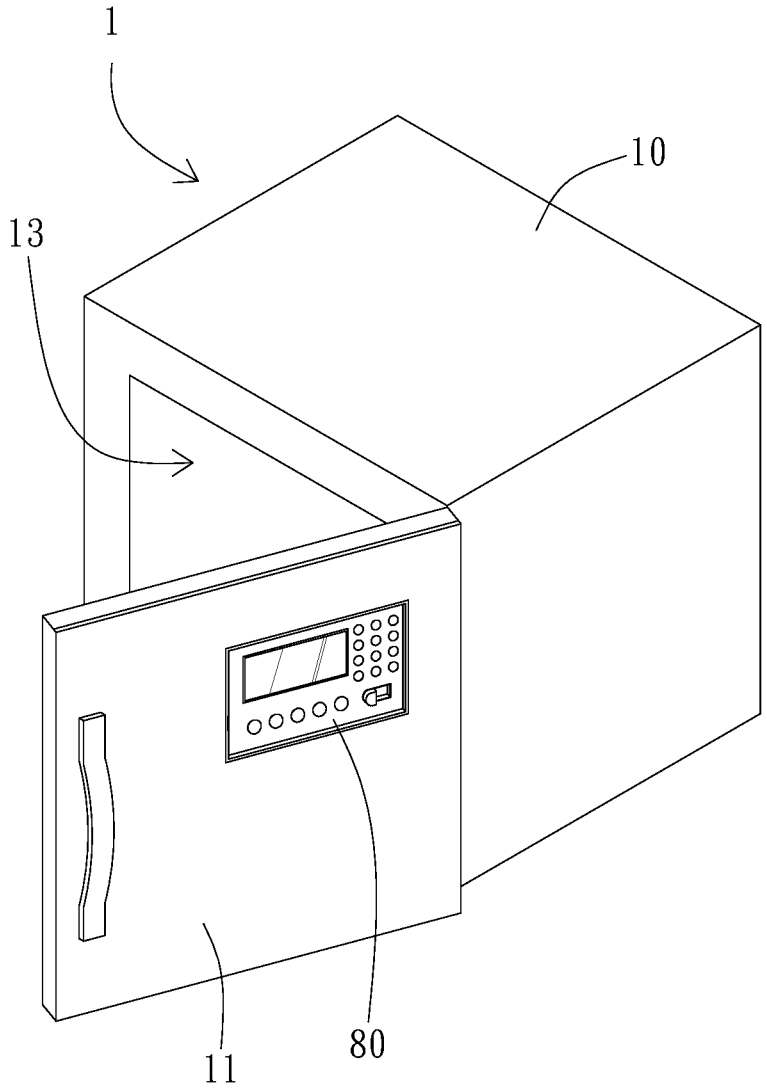
FIG. 1 is a schematic view of an appliance in a waste heat recovery system according to a preferred embodiment of the present invention.

The characteristics, subject matter, advantages, and effects of the present invention are detailed hereinafter by reference to embodiments of the present invention and the accompanying drawings. It is understood that the drawings referred to in the following description are intended only for purposes of illustration and do not necessarily show the actual proportion and precise arrangement of the embodiments. Therefore, the proportion and arrangement shown in the drawings should not be construed as limiting or restricting the scope of the present invention.

Figure 2:
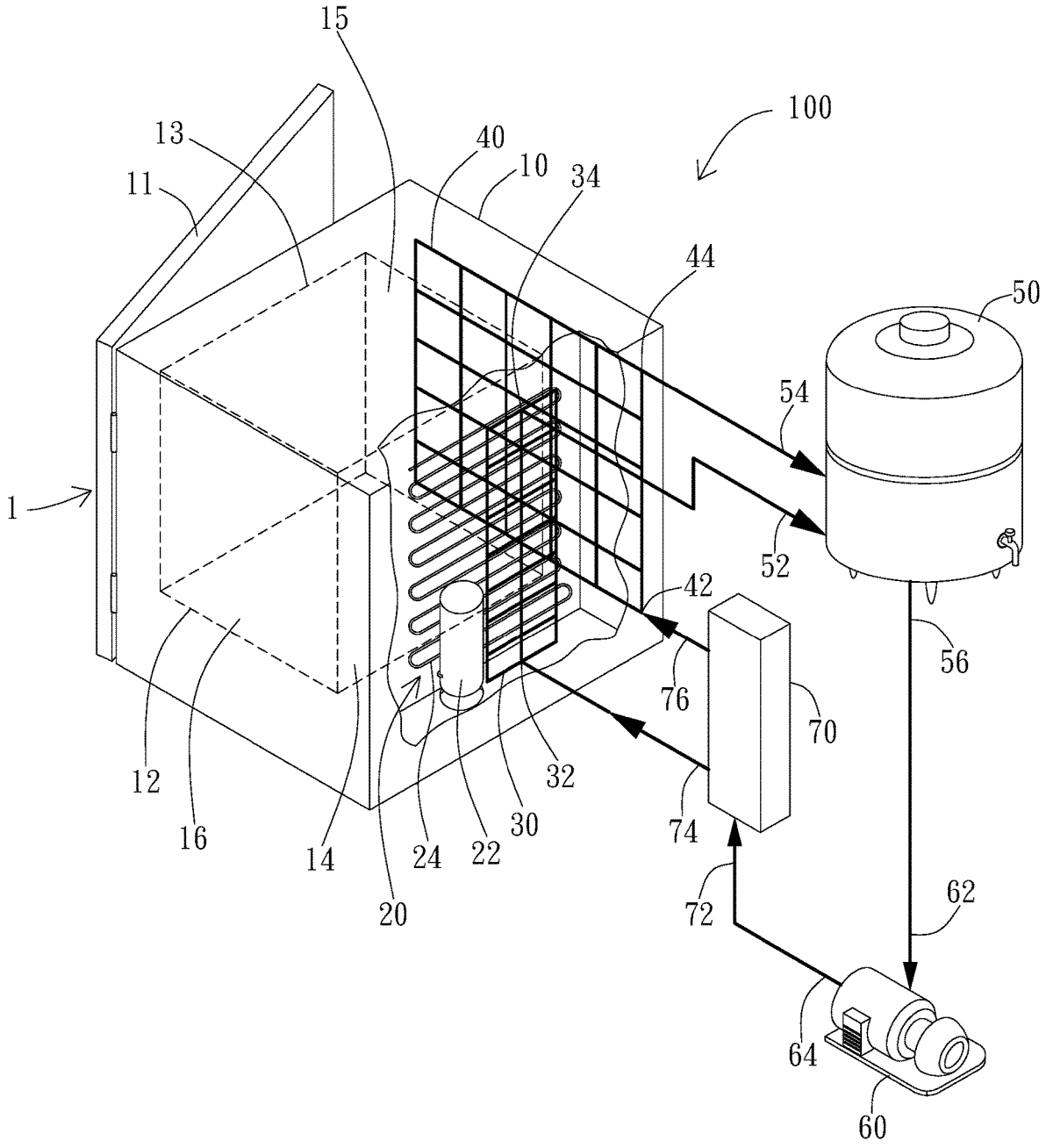
FIG. 2 is a schematic view of a waste heat recovery system according to the preferred embodiment of the present invention.

Please refer to FIG. 1 and FIG. 2. FIG. 1 is a schematic view of an appliance, such as a refrigerator, in a waste heat recovery system according to a preferred embodiment of the present invention. FIG. 2 is a schematic view of a waste heat recovery system according to the preferred embodiment of the present invention.

As shown in FIG. 2, the waste heat recovery system 100 according to the preferred embodiment of the present invention includes an appliance 1, a tank 50, a pump 60 and a pipeline switch 70. The appliance 1 comprises: a housing 10, a refrigeration module 20, a heat exchanger 30, and a circulating water pipe 40. The housing 1 has a space 12 therein and the space 12 is formed of a plurality of side walls 14, 15, 16, etc. The housing 10 includes a cover 11 configured to seal the space 12 and cover an opening 13. The cover 11 is pivotally connected to an edge next to the opening 13 of the housing 10. The refrigeration module 20 is disposed between a first side wall 14 and the housing 10, for maintaining the space 12 at a refrigeration temperature and heat dissipation. The refrigeration temperature is a low temperature at which the space 12 maintains freshness of food, and is preferably between 3 degrees Celsius and 6 degrees Celsius, but is not limited thereto. In an embodiment, the refrigeration module 20 preferably has a refrigerant unit 22 and a heat exchange pipe 24 connected to each other. The refrigerant unit 22 is impregnated with a refrigerant, which is reciprocally cycled between the refrigerant unit 22 and the heat exchange pipe 24 to dissipate heat energy.

The heat exchanger 30 is disposed between the housing 10 and the refrigeration module 20 and is configured to absorb the heat energy. The heat exchanger 30 in an alternative embodiment is preferably disposed at a position corresponding to the heat exchange pipe 24 so as to absorb the heat energy generated by the heat exchange pipe 24 of the refrigeration module 20. The heat exchanger 30 has a first inlet end 32 and a first outlet end 34. The heat exchanger 30 has a first inlet end 32 and a first outlet end 34. The tank 50 has a first water inlet 52, a second water inlet 54, and a first water outlet 56. The first water inlet 52 of the tank 50 is connected to the first outlet end 34 of the heat exchanger 30, and the second water inlet 54 of the tank 50 is connected to the second outlet end 44 of the circulating water pipe 40. The pump 60 has a third water inlet 62 and a second water outlet 64, and the third water inlet 62 of the pump 60 is connected to the first water outlet 56 of the tank 50. The pipeline switch 70 has a fourth water inlet 72, a third water outlet 74, and a fourth water outlet 76. The fourth water inlet 72 of the pipeline switch is connected to the second water outlet 64 of the pump 60, and the third water outlet 74 of the pipeline switch 70 is connected to the first inlet end 32 of the heat exchanger 30. The fourth water outlet 76 of the pipeline switch 70 is connected to the second inlet end 42 of the circulating water pipe 40. The pipeline switch 70 is configured to switch between the third water outlet 74 and the fourth water outlet 76 thereof.

The circulating water pipe 40 is disposed between the second side wall 15 and the housing 10. The location of the circulating water pipe 40 preferably corresponds to the entire second side wall 15 but is not limited thereto. In an alternative embodiment, the circulating water pipe 40 can be disposed between the third side wall 16 and the housing 10, between a top face of the space 12 and the housing 10, and/or between a bottom surface of the space 12 and the housing 10. The circulating water pipe 40 can also be arranged at another location within the housing.

In the freezing mode, the space 12 is maintained at a low temperature and the appliance 1 dissipates heat energy. Also, when the appliance 1 is in freezing mode, the refrigeration module 20 is actuated, and the pipeline switch 70 is switched to the third water outlet 74, so that water flowing from the tank 50 and through the heat exchanger 30 is heated to a moderate temperature and is thereafter stored in the tank 50. Specifically, the heat exchanger 30 absorbs the heat energy dissipated by the refrigeration module 20, and water in the heat exchanger 30 is heated to a moderate temperature, which is then output to the tank 50 through the first outlet end 34 of the heat exchanger 30. The foregoing water heating circulating operation is continued, until a water temperature inside the tank 50 reaches a predetermined temperature. The predetermined temperature is preferably between 20 degrees Celsius and 40 degrees Celsius, and is more preferably between 30 degrees Celsius and 40 degrees Celsius but is not limited thereto. In a preferred embodiment, when the water temperature inside the tank 50 reaches the predetermined temperature, a control unit (not shown in the figure) may control the pump 60 to be turned off so as to stop the water heating operation. The water temperature may be detected, for example, by using a temperature detector or a thermometer.

When the appliance 1 is in a thawing mode, the refrigeration module 20 is terminated, and the pipeline switch 70 is switched to the fourth water outlet 76 so that water at the moderate temperature flows from the tank 50 to the circulating water pipe 40 to heat the space 12. The pipeline switch 70 switches the water discharging path to the fourth water outlet 76 so that the moderate temperature water in the bucket flows to the circulating water pipe 40 to heat the space 12, thereby thawing frozen food previously stored in the space 12.

As shown in FIG. 2, the tank 50, the pump 60, and the pipeline switch 70 in this embodiment are disposed outside the housing 10, but in an alternative embodiment, the tank 50, the pump 60 and the pipeline switch 70 are disposed between one or more side walls 14, 15, 16, etc. of the housing 10 and the space 12. In this embodiment, the waste heat recovery system 100 may further include at least one heat source (not shown in the figure) disposed between the third side wall 16 of the space 12 and the housing 10, and the heat source is configured to heat the space 12 so that the temperature of the space 12 rises from a low temperature to a high temperature to heat and cook food inside the space 12. The heat source can be a microwave apparatus or an electric heating apparatus. The so-called high temperature refers to a temperature that is high enough for cooking food, such as 100 degrees Celsius.

In an alternative embodiment, the waste heat recovery system 100 of the present invention may further include a timing apparatus 80 disposed on the cover 11 as shown in FIG. 1, which is configured to receive a remote signal or can be manually operated for setting the time. The signal is used to set a starting time at which the operating mode (for example, the freezing mode, the thawing mode, or cooking mode) is actuated. In an embodiment, the timing apparatus 80 preferably includes, but is not limited to, a touch panel, a key control panel, a voice control panel, or a sensing panel. The timing apparatus 80 may further include a signal receiver (not shown in the figure). The signal receiver is connected to the Internet and receives the signal from the Internet in a wireless or wired communications manner so that the operating mode is actuated according to the starting time.

Figure 3:
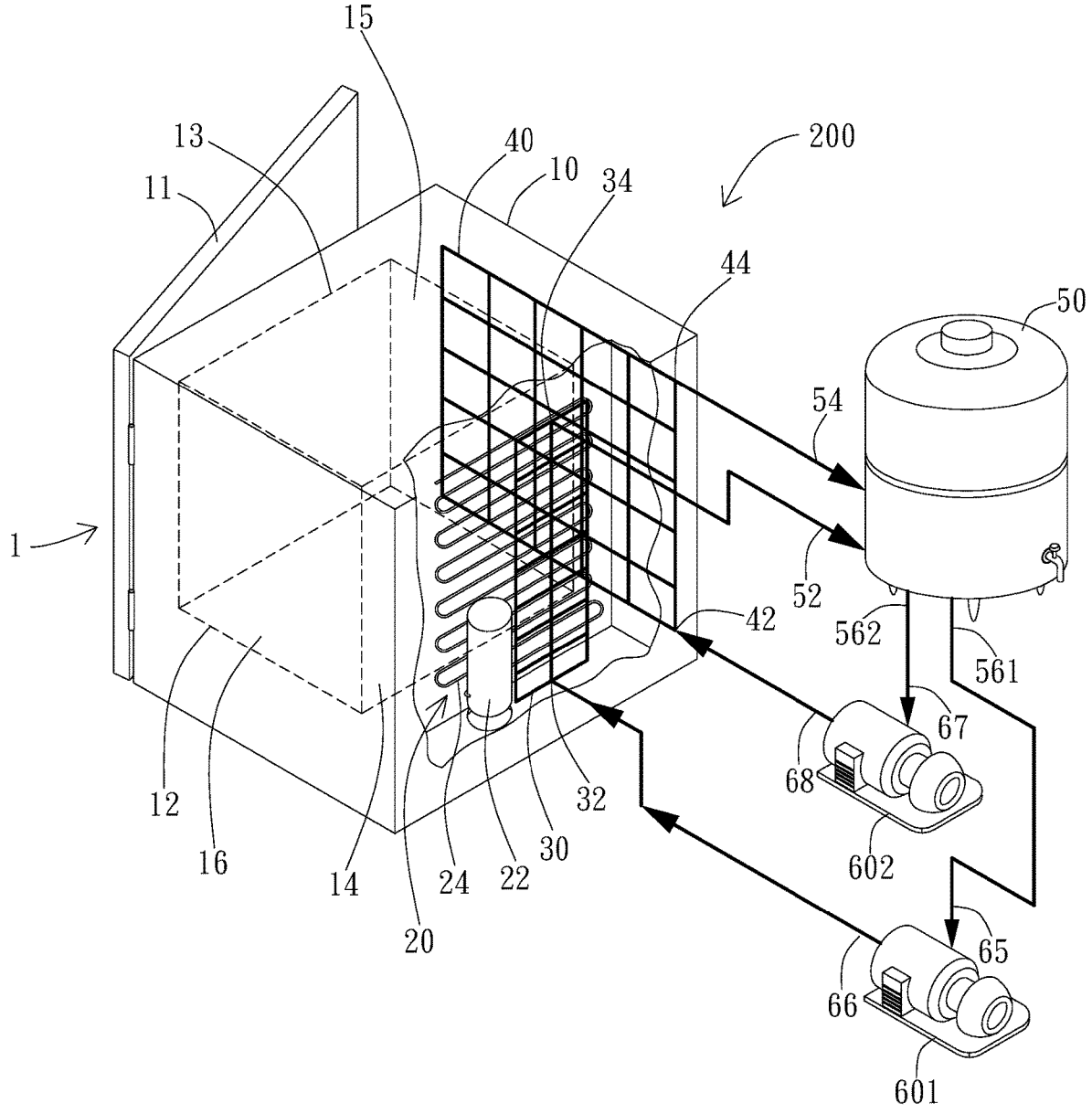
FIG. 3 is a schematic view of a waste heat recovery system according to another preferred embodiment of the present invention.

FIG. 3 is a schematic view of a waste heat recovery system 200 according to another preferred embodiment of the present invention. In this embodiment, the same reference numerals are used for indicating the same elements in the previous embodiment. The system 200 comprises: an appliance 1, a tank 50 a first pump 601 and a second pump 602. The appliance 1 comprises: a housing 10, a refrigeration module 20, a heat exchanger 30 and a circulating water pipe 40. The housing 10 has a space 12 therein, and the space 12 is formed of a plurality of side walls 14, 15, 16, etc. The refrigeration module 20 is disposed between a first side wall 14 of the plurality of side walls 14, 15, 16, etc. and the housing 10, for maintaining the space 12 at a refrigeration temperature and heat dissipation. The heat exchanger 30 is disposed between the housing 10 and the refrigeration module 20 and is configured to absorb the heat energy, wherein the heat exchanger 30 has a first inlet end 32 a first outlet end 34. The circulating water pipe 40 is disposed between a second side wall 15 of the plurality of side walls 14, 15, 16, etc. and the housing 12, wherein the circulating water pipe 40 has a second inlet end 42 and a second outlet end 44. The tank 50 has a first water inlet 52, a second water inlet 54, a first water outlet 561, and a second water outlet 562. The first water inlet 52 of the tank 50 is connected to the first outlet end 34 of heat exchanger 30, and the second water inlet 54 of the tank 50 is connected to the second outlet end 44 of the circulating water pipe 40. The first pump 601 is connected between the first water outlet 561 of the tank 50 and the first inlet end 65 of the heat exchanger 30. The second pump 602 is connected between the second water outlet 562 of the tank 50 and the second inlet end 42 of the circulating water pipe 40.

In operation, when the waste heat recovery system 200 is in freezing mode, the refrigeration module 20 is actuated, the first pump 601 is turned on, and the second pump 602 is turned off so that water flowing through the heat exchanger 30 is heated to a moderate temperature and is output to the tank 50. The foregoing water heating and circulation continues until a water temperature inside the tank 50 reaches a predetermined temperature. The predetermined temperature is preferably between 20 degrees Celsius and 40 degrees Celsius, and is more preferably between 30 degrees Celsius and 40 degrees Celsius but is not limited thereto. In a preferred embodiment, when the water temperature inside the tank 50 reaches the predetermined temperature, a control unit (not shown in the figure) turns off the first pump 601 to stop the water heating. The water temperature may be detected, for example, by using a temperature detector or a thermometer.

When the waste heat recovery system 200 is in thawing mode, through orders sent from a control unit (not shown), the refrigeration module 20 stop working, the first pump 601 is turned off, and the second pump 602 is turned on so that the moderate temperature water in the tank 50 is pumped by the second pump 602 and flows to the circulating water pipe 40 for heating the space 12 and thawing frozen food stored in the space 12.

In the embodiment of FIG. 3, the tank 50, the first pump 601, and the second pump 602 are disposed outside the housing 10 of the appliance 1. In an alternative embodiment, the tank 50, the first pump 601, and the second pump 602 are disposed a suitable location between the housing 10 and the space 12.

In an alternative embodiment, the waste heat recovery system 200 includes at least one heat source (not shown in the figure) disposed between a third side wall 16 of the space 12 and the housing 10, and the heat source is configured to heat the space 12 so that the temperature of the space 12 rises from a low temperature to a high temperature for heating and/or cooking food. The heat source may be a microwave apparatus or an electric heating apparatus.

In an alternative embodiment, the waste heat recovery system 100 of the present invention may further include a timing apparatus 80 disposed on the cover 11 as shown in FIG. 1, which is configured to receive a remote signal or can be manually operated for setting the time. The signal is used to set a starting time at which the operating mode (for example, the freezing mode, the thawing mode, or cooking mode) is actuated. In an embodiment, the timing apparatus 80 preferably includes, but is not limited to, a touch panel, a key control panel, a voice control panel, or a sensing panel. The timing apparatus 80 may further includes a signal receiver (not shown in the figure). The signal receiver is connected to the Internet and receives the signal from the Internet in a wireless or wired communications manner so that the operating mode is actuated according to the starting time.

In view of the above, the appliance 1 in the waste heat recovery system 100, 200 of the present invention in some embodiments, has refrigeration, thawing, and cooking modes. That is, the appliance 1 has functions of both a refrigerator and an oven.

The embodiments of the invention provides benefits, such as recovering heat energy generated by the refrigeration module 20 and storing the energy in a water tank 50, and the saved energy can be used to thaw the food in the appliance 1 so that energy consumption used for maintaining the appliance 1 can be effectively reduced.

The foregoing embodiments are illustrative of the technical concepts and characteristics of the present invention to enable a person skilled in the art to gain insight into the content disclosed herein and to implement the present invention accordingly. However, it is understood that the embodiments are not intended to restrict the scope of the present invention. Hence, all equivalent modifications and variations made to the disclosed embodiments without departing from the spirit and principle of the present invention should fall within the scope of the appended claims.

What is claimed is:

1. A waste heat recovery system, comprising:

an appliance, comprising:

a housing having an enclosed space therein, the enclosed space resulting from a first side wall, a second side wall, a third side wall, a top wall, a bottom wall, and a door;

a refrigeration module, disposed between the first side wall and a first external surface of the housing, for maintaining the enclosed space at a refrigeration temperature and heat dissipation;

a heat exchanger, disposed between the first external surface of the housing and the refrigeration module and configured to absorb the heat energy from the refrigeration module, wherein the heat exchanger has a first inlet end and a first outlet end; and a circulating water pipe, disposed between the second side wall and a second external surface of the housing, wherein the circulating water pipe has a second inlet end and a second outlet end;

a tank, having a first water inlet, a second water inlet, a first water outlet, and a second water outlet, the first water inlet of the tank being connected to the first outlet end of heat exchanger, and the second water inlet being connected to the second outlet end of the circulating water pipe;

a first pump, connected between the first water outlet of the tank and the first inlet end of the heat exchanger for controlling a first circulation loop through the tank, the first pump and the heat exchanger; and a second pump, connected between the second water outlet of the tank and the second inlet end of the circulating water pipe for controlling a second circulation loop through the tank, the second pump and the circulating water pipe, and the first circulation loop and the second circulation loop intersecting at the tank;

wherein the system is configured to be in a freezing mode or a thawing mode; when the system is in the freezing mode, the refrigeration module is actuated, and the first pump is turned on to cool the enclosed space, and when the system is in the thawing mode, the refrigeration module stops working, the first pump is turned off, and the second pump is turned on by a control unit to heat the enclosed space, such that the enclosed space is either cooled via the refrigeration module or heated via the circulating water pipe, wherein the cooling and the heating modes are executed individually at separate times rather than simultaneously, wherein when the appliance is in the freezing mode, the refrigeration module is actuated, the first pump is turned on to open the first circulation loop, and the second pump is turned off to close the second circulation loop; the heat exchanger absorbs heat from the enclosed space so that water flowing through the heat exchanger is heated to a moderate temperature and is thereafter stored in the tank, wherein when the appliance is in the thawing mode, the refrigeration module is terminated, the first pump is turned off to close the first circulation loop, and the second pump is turned on to open the second circulation loop, so that the heated water from the heat exchanger at the moderate temperature in the tank flows to the circulating water pipe to heat the enclosed space.

2. The waste heat recovery system according to claim 1, further comprising a heat source disposed between the third side wall of the enclosed space and the housing, wherein the heat source is configured to heat the enclosed space.

3. The waste heat recovery system according to claim 2, wherein the heat source is a microwave apparatus or an electric heating apparatus.

4. The waste heat recovery system according to claim 1, wherein the tank, the first pump, and the second pump are disposed between the housing and the third side wall.

5. The waste heat recovery system according to claim 1, further comprising a timing apparatus that can be physically or remotely controlled for actuating the appliance.

6. The waste heat recovery system according to claim 5, wherein the timing apparatus has a signal receiver that is connected to the Internet for receiving a signal from the Internet to actuate the appliance.

7. The waste heat recovery system according to claim 1, wherein the refrigeration module has a refrigerant unit connected with a heat exchange pipe, wherein the refrigerant unit is impregnated with a refrigerant that is reciprocally cycled between the refrigerant unit and the heat exchange pipe for dissipating heat energy.

* * * * *